United States Patent [19]

Mixner

[11] 4,174,568

[45] Nov. 20, 1979

[54] SHAVING HEAD FOR DRYSHAVING APPARATUS

[75] Inventor: Ingomar Mixner, Klagenfurt, Austria

[73] Assignee: U.S. Philips Corporation, New York, N.Y.

[21] Appl. No.: 891,713

[22] Filed: Mar. 30, 1978

[30] Foreign Application Priority Data

May 3, 1977 [AT] Austria ..... 3131/77

[51] Int. Cl.[2] ..... B26B 19/04; B26B 19/20

[52] U.S. Cl. ..... 30/34.1; 30/43.92

[58] Field of Search ..... 30/34.1, 43.8, 43.9, 30/43.91, 43.92, 346.51

[56] References Cited

U.S. PATENT DOCUMENTS

| | | | |
|---|---|---|---|
| 3,343,258 | 9/1967 | Loner | 30/43.92 X |
| 3,436,822 | 4/1969 | Heyek | 30/34.1 |
| 3,453,728 | 7/1969 | Loner | 30/346.51 X |
| 3,774,300 | 11/1973 | Konig | 30/346.51 X |
| 3,855,697 | 12/1974 | Meyer | 30/43.92 X |

*Primary Examiner*—Gary L. Smith

*Attorney, Agent, or Firm*—Thomas A. Briody; William J. Streeter; Rolf E. Schneider

[57] ABSTRACT

A shaving head for a dry shaver comprising a shaving-head frame formed with parallel lonigitudinal side members each having a contact surface provided with projecting pins engaging corresponding openings in a flexible shear foil. A further member is arranged parallel to each longitudinal side member and has a surface spaced from the free ends of the respective pins, the longitudinal sides of the flexible shear foil extending into the resulting spaces between the respective contact surfaces and the associated further member surfaces whereby the flexible shear foil is captively attached to the shaving-head frame.

2 Claims, 2 Drawing Figures

SHAVING HEAD FOR DRYSHAVING APPARATUS

Figure 1:
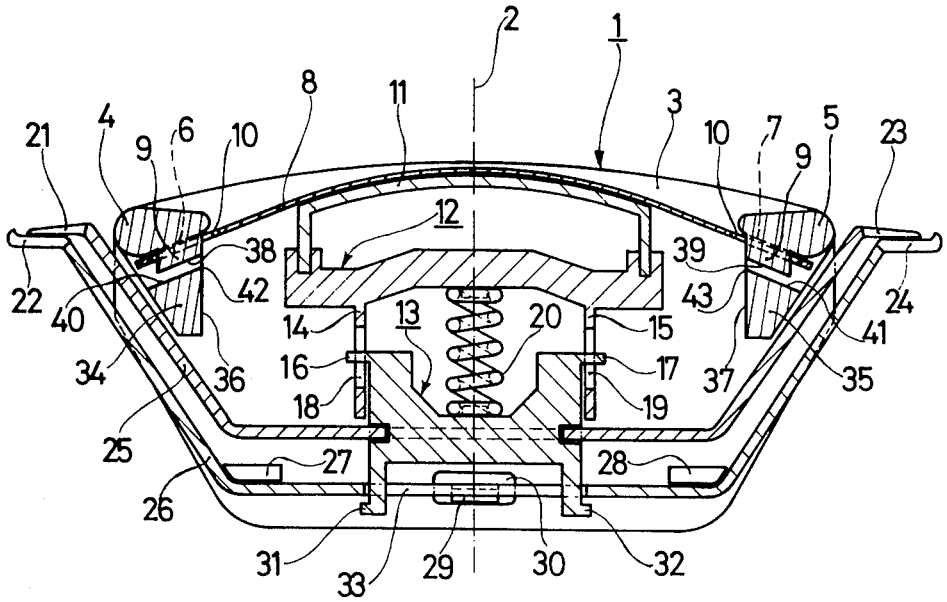

This invention relates to a shaving head for dry shaving apparatus comprising a shaving head frame, whose longitudinal members which extend parallel to its longitudinal plane of symmetry each has a contact surface for a flexible shear foil which is arcuated in the operating position and which cooperates with a reciprocatable lower cutter, at least one pin for retaining the shear foil, in which corresponding openings are formed, projecting from each of the contact surfaces. Such a shaving head is for example described in U.S. Pat. No. 3,453,728. The flexible shear foils used in such shaving heads are comparatively thin and may therefore readily be damaged in case of incorrect use. This is likely to happen in particular when for example the shaving head frame with the shear foil is removed from the shaving head for cleaning purposes, because in that case the shear foil may become detached from the shaving-head frame.

It is an object of the present invention to provide a particularly reliable attachment of the shear foil to the shaving head frame and to eliminate the aforementioned problems in a simple manner. In accordance with the invention this object is achieved in that in a shaving head of the above-mentioned type parallel to each longitudinal member, opposite the free end of the relevant pin, there is disposed a further member, that said further members have confronting first bounding surfaces which extend substantially parallel to the longitudinal plane of symmetry and together form an insertion duct for the shear foil, that the two further members each has a second bounding surface which adjoins the first bounding surface and which faces and is spaced from the free end of the relevant pin, which second bounding surfaces are each disposed in one of two planes which relative to the longitudinal plane of symmetry form a roof-shape in accordance with the curvature of the shear foil, and that the plane which extends through the edges constituted by the first and second bounding surfaces of the two further members intersects the free ends of the pins. This provides a captive attachment of the shear foil to the shaving-head frame of the shaving head for the user of the dry shaving apparatus, which assures that the shear foil cannot inadvertently become detached from the shaving-head frame. Thus, damage to the shear foil, in particular during cleaning of the shaving head, is virtually eliminated.

A particularly simple construction is characterized in that the pin on each longitudinal member is bounded at its free end by a surface which extends substantially parallel to the contact surface of the relevant longitudinal member and that the second bounding surface on the further member also extends substantially parallel to the contact surface of the relevant longitudinal member.

Figure 2:
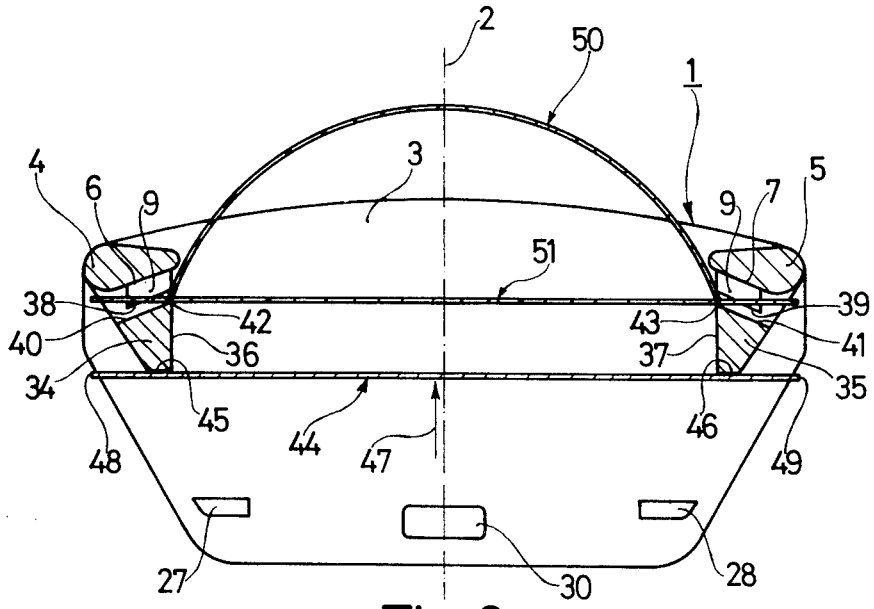

The invention will now be described in more detail with reference to the drawing, in which:

FIG. 1 shows a cross-section through the shaving head normal to its longitudinal plane of symmetry, and FIG. 2 is a cross-section of the frame of the shaving head of FIG. 1 also normal to its longitudinal plane of symmetry, showing the various positions of the shear foil which it assumes when it is fitted into the shaving-head frame in its operating position.

The shaving head for a dry-shaving apparatus shown in FIG. 1 comprises a shaving-head frame 1, which consists of two side walls 3, which extend normal to the longitudinal plane of symmetry 2, and two longitudinal members 4 and 5 which extend parallel to the longitudinal plane of symmetry. Each of said longitudinal members 4 and 5 has a contact surface 6 and 7 respectively for a flexible shear foil 8 which is arcuated in the operating position. For retaining the shear foil there are provided pins 9, two such adjoining pins being arranged on each of the two longitudinal members 4 and 5, from whose contact surfaces 6 and 7 they project. These pins 9 cooperate in the usual manner with corresponding openings 10 formed in the shear foil 8, in that they pass through said openings.

The shaving head furthermore comprises a lower cutter 11, with which the shear foil 8 cooperates. This lower cutter 11 is disposed on a support 12, which in its turn is movable in a direction normal to the shear foil 8 and is connected to a drive element 13 which is reciprocatable by a motor of the dry-shaving apparatus in a manner not shown. In order to form this connection there are provided walls 14 and 15 on the support 12, which laterally surround the drive element 13, projections 16 and 17 formed on said element respectively engaging with slots 18 and 19 which are formed in the walls 14 and 15 respectively. Two adjacent helical springs 20, which on one end bear against the support 12 and on the other end against the drive element 13, tend to urge these two parts away from each other, so that the lower cutter 11 is kept in engagement with the shear foil 8.

In addition to the shaving section described in the foregoing the shaving head also comprises two trimming cutters. These cutters are constituted by the rows of cutting teeth 21, 22 and 23, 24, which slide over each other, and are formed on the lateral edges of two channel-shaped cutters 25 and 26. In this case the cutter 25 is rigidly connected to the drive element 13 and is thus drivable. The other stationary cutter 26 bears against the projections 27 and 28, which are disposed on the two side walls 3 of the shaving head frame 1, said cutter being fixed to these side walls 3 by means of two snapped connections. These snapped connections each comprise a projection 29 on the two short sides of the cutter 26 and a corresponding opening 30 in the side walls 3 of the shaving-head frame 1 for engagement with the relevant projection. Thus, the stationary cutter 26 constitutes an abutment for the forces exerted by the helical springs 20, so that both the rows 21 and 23 of cutting teeth of the drivable cutter 25 of the two trimming cutters are urged against the rows of cutting teeth 22 and 24 of the stationary cutter 26 and the lower cutter 11 is urged against the shear foil 8.

By releasing the snapped connections of the cutter 26 with the shaving-head frame 1, the component parts of the shaving head can be disassembled. Suitably, the cutter 26 is combined in a structural unit with the drivable part of the shaving head, namely the cutter 25, the drive element 13 and the support 12 with the lower cutter 11, which unit can bodily be removed from the shaving-head frame 1. For this purpose hook-shaped projections 31 and 32 on the drive element 13 engage with a central opening 33 in the cutter 26, thus at the same time constituting a guide for the reciprocatable drive element 13.

In the present example the pins 9 which serve for retaining the shear foil 8 are oriented parallel to the longitudinal plane of symmetry 2. Furthermore, a further member 34 and 35 is disposed parallel to each of the two longitudinal members 4 and 5, viewed in line with the pins 9. The said further members 34 and 35 each has a first bounding surface 36 and 37, which extends parallel to the longitudinal plane of symmetry. These first bounding surfaces 36 and 37 face each other and thus constitute an insertion duct, which is bounded by parallel walls, for the shear foil, as is to be explained hereinafter. As the case may be, the insertion duct may also be constituted by walls which taper down in the direction of the operating position of the shear foil.

Furthermore, these two further members 34 and 35 each has a second bounding surface 40 and 41, facing the free ends 38 and 39 of the relevant pins 9 and being spaced therefrom. These second bounding surfaces 40 and 41 are each disposed in one of the two planes which relative to the longitudinal plane of symmetry 2 form a roof-shape in accordance with the curvature of the shear foil 8 and adjoin the first bounding surfaces 36 and 37, the plane which extends through the edges formed by the first and second bounding surfaces 36, 40 and 37, 41 respectively intersecting with the respective free ends 38 and 39 of the pins 9. The distance between the free ends 38 and 39 of the pins 9 and the second bounding surfaces 40 and 41 respectively may be a multiple of the thickness of the shear foil, so as to facilitate insertion into the clearances thus formed and also so as to enable easy insertion by hand.

In the present example the pins 9 are bounded at their free ends 38 and 39 by a plane which respectively extends parallel to the contact surfaces 6 and 7 of the relevant longitudinal members 4 and 5. Obviously, it is also possible to shape the free ends of the pins 9 differently, for example in that they are rounded or are given a nose-like shape. Furthermore, the second bounding surfaces 40 and 41 also extend parallel to the respective contact surfaces 6 and 7 of the relevant longitudinal members 4 and 5. In this respect it is of course also possible to arrange these second bounding surfaces at a different angle.

Owing to the described arrangement a particularly reliable attachment of the shear foil to the shaving head frame is obtained, because it cannot become detached inadvertently, as will be explained hereinafter with reference to FIG. 2. in FIG. 2 the initial position for mounting the shear foil in the shaving head frame 1 is indicated by the reference numeral 44. The shear foil is then positioned against the surfaces 45 and 46 of the relevant further members 34 and 35, which surfaces face away from the longitudinal members 4 and 5. When manual force is exerted on the shear foil approximately in its centre, in the direction of the arrow 47, the shear foil is curved in the direction of this arrow until it slides with its sides 48 and 49 along the first bounding surfaces 36 and 37 of the further members 34 and 35 which constitute an insertion duct. This force is exerted on the shear foil until it has reached the position designated 50 in FIG. 2, in which its sides 48 and 49 are introduced into the clearance between the second bounding surfaces 40 and 41 of the further members 34 and 35 respectively and the free ends 38 and 39 of the pins 9. If in this position of the shear foil the force is no longer exerted on it, the shear foil again tends to straighten under the influence of its elastic flexibility, so that it assumes the position designated by the reference numeral 51 in FIG. 2. During this straightening of the shear foil the free ends 38 and 39 of the pins 9 engage with corresponding openings 10 of the shear foil, after which the shear foil is positioned on the edges 42 and 43 of the further members 34 and 35. It is to be noted that the openings 10 of the shear foil are not visible in FIG. 2, because the cross-section of FIG. 2 has not been taken at the location of the pins 9, in order to illustrate the positioning of the shear foil on the edges 42 and 43. In this position the shear foil is already captively attached to the shaving head frame, because the free ends 38 and 39 of the pins 9 which pass through the openings 10 of the shear foil prevent the extended shear foil from becoming detached from the shaving head frame. This is because the plane which passes through the edges 42 and 43 of the further members 34 and 35 intersects with the free ends 38 and 39 of the pins 9. If again a force is exerted on the shear foil in the direction of the arrow 47, which happens when the lower cutter 11 is brought into its operating position, the shear foil also assumes its arcuated operating position, in which it engages with the contact surfaces 6 and 7 of the relevant longitudinal members 4 and 5 respectively, as is shown in FIG. 1. If said force is no longer exerted on the shear foil, for example when the lower cutter 11 is removed from the shaving head frame for cleaning purposes, the shear foil can return to the position designated 51 in FIG. 2, without becoming detached from the shaving head frame, because the free ends 38 and 39 of the pins 9 still project through the opening 10 of the extended shear foil and thus captively retain said foil.

Thus, it is ensured that the shear foil cannot inadvertently become detached from the shaving-head frame, which as previously stated, is of particular importance when the shaving head is to be cleaned. Because of this reliable attachment of the shear foil to the shaving-head frame damage to the shear foil is, above all, avoided.

If the shear foil is to be removed from the shaving-head frame, for example in order to replace it, this is done by holding it near one of the longitudinal members 4 and 5 and curving it so far that the free ends 38 and 39 of the relevant pins 9 are disengaged from the openings 10 of the shear foil, after which the shear foil is pulled out of the clearance between the free ends of the relevant pins 9 and the relevant second bounding surfaces 40 and 41 of the members 34 and 35 respectively. It is evident that this is an operation which is to be performed deliberately and which cannot be effected by mistake, which absolutely ensures that the shear foil cannot inadvertently become detached from the shaving head frame.

What is claimed is:

1. A shaving head for a dry shaver, which comprises a longitudinally extending flexible shear foil arcuated in the operating position, a longitudinally reciprocatable cutter cooperating with said flexible shear foil in such position, a longitudinally extending shaving-head frame having two longitudinal side members extending parallel to the longitudinal plane of symmetry of the shaving-head frame, each longitudinal side member having a contact surface for engagement with said flexible shear foil, at least one pin projecting from each contact surface, corresponding openings formed in said flexible shear foil for respectively receiving said pins, and a further member disposed in said shaving-head frame parallel to each longitudinal side member and opposite the free ends of the pins projecting from the contact surface thereof, said two further members each having a first surface extending parallel to the longitudinal plane of symmetry of the shaving-head frame, said two first surfaces facing each other and defining an aperture for insertion of the flexible shear foil into said shaving-head frame, said two further members also each having a second surface adjoining the respective first surface and forming an edge therewith, each second surface facing the contact surface of its associated longitudinal side member and being spaced from the free ends of the pins projecting from said contact surface, the opposite longitudinal sides of said flexible shear foil extending into the spaces between the respective second surfaces and the respective contact surfaces, the second surfaces being respectively disposed in two planes converging in accordance with the curvature of the flexible shear foil, and the plane extending through the edges of the two further members intersecting the projecting pins.

2. A shaving head according to claim 1, in which the pins projecting from each contact surface each has a free end surface extending parallel to its contact surface, and the associated second surface extends parallel to said contact surface.

* * * * *